US007056161B2

(12) United States Patent
Delcourt et al.

(10) Patent No.: US 7,056,161 B2
(45) Date of Patent: Jun. 6, 2006

(54) GROUNDING STUD

(75) Inventors: Mark H. Delcourt, Emmett, MI (US); Thomas Gouin, Grosse Pointe Woods, MI (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/842,641

(22) Filed: May 10, 2004

(65) Prior Publication Data

US 2004/0253853 A1 Dec. 16, 2004

Related U.S. Application Data

(63) Continuation-in-part of application No. 10/075,090, filed on Feb. 12, 2002, now Pat. No. 6,746,285.

(60) Provisional application No. 60/270,084, filed on Feb. 20, 2001.

(51) Int. Cl.
*H01R 4/38* (2006.01)

(52) U.S. Cl. ..... 439/766; 174/51; 411/181

(58) Field of Classification Search ..... 439/80, 439/92, 766, 883; 411/107, 181; 174/51
See application file for complete search history.

(56) References Cited

U.S. PATENT DOCUMENTS

| | | | | |
|---|---|---|---|---|
| 4,002,390 | A | | 1/1977 | Perry et al. |
| 4,192,215 | A | | 3/1980 | Hymans |
| 4,936,796 | A | | 6/1990 | Anderson, Jr. |
| 5,207,588 | A | | 5/1993 | Ladouceur et al. |
| 5,292,264 | A | | 3/1994 | Blank |
| 5,413,500 | A | | 5/1995 | Tanaka |
| 5,442,133 | A | | 8/1995 | Arnold et al. |
| 5,462,453 | A | | 10/1995 | Muller |
| 5,644,830 | A | | 7/1997 | Ladouceur et al. |
| 5,655,936 | A | | 8/1997 | Meredith |
| 5,707,257 | A | | 1/1998 | Kotajima et al. |
| 5,730,566 | A | | 3/1998 | Goodwin et al. |
| 5,775,930 | A | | 7/1998 | Model et al. |
| 5,868,535 | A | * | 2/1999 | Ladouceur ..... 411/181 |
| 6,027,382 | A | | 2/2000 | Reindl et al. |
| 6,062,786 | A | | 5/2000 | Garver et al. |
| 6,071,153 | A | | 6/2000 | Fink et al. |
| 6,077,096 | A | | 6/2000 | Moring et al. |
| 6,127,628 | A | * | 10/2000 | Baur et al. ..... 174/51 |
| 6,142,813 | A | | 11/2000 | Cummings et al. |
| 6,162,001 | A | | 12/2000 | Goodwin et al. |
| 6,162,085 | A | | 12/2000 | Chugh et al. |
| 6,168,445 | B1 | | 1/2001 | Seutschniker et al. |
| 6,171,146 | B1 | | 1/2001 | Fink et al. |

(Continued)

FOREIGN PATENT DOCUMENTS

DE 44 25 839 A1 1/1996

(Continued)

OTHER PUBLICATIONS

Declaration Overcoming a Reference under 37 CFR 1.132 and attachments (5) from U.S. Appl. No. 09/907,062; 9 pages.

(Continued)

*Primary Examiner*—Thanh-Tam Le
(74) *Attorney, Agent, or Firm*—Harness, Dickey & Pierce, P.L.C.

(57) ABSTRACT

A preferred embodiment of an electrical connection employs a stud having a patterned segment, a shoulder and a flange. In another aspect of the present invention, the shoulder has seven or more predominantly flat faces. In a further aspect of the present invention, the shoulder has an octagonal cross sectional shape.

18 Claims, 3 Drawing Sheets

U.S. PATENT DOCUMENTS

| | | | | |
|---|---|---|---|---|
| 6,176,746 | B1 | 1/2001 | Morello et al. | |
| 6,179,658 | B1 | 1/2001 | Gunay et al. | |
| 6,203,364 | B1 | 3/2001 | Chupak et al. | |
| 6,210,186 | B1 | 4/2001 | Fink et al. | |
| 6,213,795 | B1 | 4/2001 | Drescher et al. | |
| 6,244,517 | B1 | 6/2001 | Courtois et al. | |
| 6,247,965 | B1 | 6/2001 | Cummings et al. | |
| 6,250,975 | B1 | 6/2001 | LaPointe | |
| 6,276,960 | B1 | 8/2001 | Schaefer et al. | |
| 6,305,957 | B1 | 10/2001 | Fink et al. | |
| 6,322,376 | B1 * | 11/2001 | Jetton | 439/76.2 |
| 6,329,592 | B1 * | 12/2001 | Auclair | 174/51 |
| 6,338,651 | B1 | 1/2002 | Svette, Jr. et al. | |
| 6,357,110 | B1 * | 3/2002 | Shipp et al. | 29/825 |
| 6,361,356 | B1 | 3/2002 | Heberlein et al. | |
| 6,379,162 | B1 | 4/2002 | Raypole et al. | |
| 6,383,033 | B1 | 5/2002 | Politsky et al. | |
| 6,406,307 | B1 | 6/2002 | Bungo et al. | |
| 6,416,119 | B1 | 7/2002 | Gericke et al. | |
| 6,422,881 | B1 | 7/2002 | Puhl et al. | |
| 6,485,318 | B1 | 11/2002 | Schoepf | |
| 6,485,337 | B1 | 11/2002 | Hsieh | |
| 6,491,487 | B1 | 12/2002 | Wojciechowski | |
| 6,494,751 | B1 | 12/2002 | Morello et al. | |
| 6,508,666 | B1 | 1/2003 | Francis | |
| 6,527,573 | B1 | 3/2003 | Stein, Sr. et al. | |
| 6,533,611 | B1 | 3/2003 | Morello et al. | |
| 6,537,099 | B1 | 3/2003 | Herlinger et al. | |
| 6,547,605 | B1 | 4/2003 | Daugherty et al. | |
| 6,565,372 | B1 | 5/2003 | Bakker et al. | |
| 6,607,339 | B1 | 8/2003 | Mangapora | |
| 6,607,393 | B1 | 8/2003 | Raypole et al. | |
| 6,746,285 | B1 | 6/2004 | Delcourt et al. | |
| 2002/0115317 | A1 | 8/2002 | Delcourt et al. | |
| 2003/0017391 | A1 | 1/2003 | Peterson et al. | |

FOREIGN PATENT DOCUMENTS

| | | |
|---|---|---|
| EP | 0 487 365 | 5/1992 |
| EP | 0 533 421 | 9/1992 |
| EP | 0 540 030 A2 | 5/1993 |
| EP | 0 915 531 | 5/1999 |
| JP | 62-5569 | 1/1987 |

OTHER PUBLICATIONS

Emhart Fastening Teknologies—NPR Studs; Internet document published Jul. 1, 1999; 2 pages.

Parker-Kalon—AA Series—Projection Weld Stud; Internet document published Jul. 1, 1999; 4 pages.

A. Illustration of an assembly tool fixture in generic public use since at least before Apr. 2000.

B. Pictures of a ground block with anti-rotation bent tab and hole terminal assembly in generic public use since before at least Apr. 2000.

C. Loose piece, plastic molded anti-rotation wheel of Volkswagen, Germany; dated 1999; 4 pictures.

* cited by examiner

GROUNDING STUD

CROSS REFERENCE TO RELATED APPLICATIONS

This application is a continuation-in-part of U.S. Ser. No. 10/075,090, filed Feb. 12, 2002 now U.S. Pat. No. 6,746,285, which claims priority to U.S. Provisional Ser. No. 60/270,084, filed Feb. 20, 2001, both of which are incorporated by reference herein.

BACKGROUND OF THE INVENTION

This invention relates generally to an electrical connection and more specifically to an electrical connection for an automotive vehicle employing a grounding stud.

It is common to arc weld an elongated circular end of a threaded metal stud onto a sheet metal body panel of an automotive vehicle. Various parts are then inserted upon the single threaded stud and an internally threaded nut is rotationally inserted onto the stud. Conventional threaded weld studs have also been employed as electrical grounding points for a vehicle wire harness to an engine compartment frame or body panel. It is also known to employ a grounding weld stud that has a threaded portion, a circular flanged portion and a hexagonal shoulder portion for receiving an eyelet. This hexagonal shoulder configuration, however, provides undesirably large corner-to-corner and flat-to-flat dimensions across the shoulder in order to fit within standard stud welding machinery which can only handle a certain maximum outside diameter of stud; thus, the hexagonal shoulder leads to insufficient cross sectional area for electrical conductivity.

Screws have also been used to retain an electrical eyelet to a grounding panel. Conventional eyelets, having a circular inside aperture, often require upturned tabs to prevent rotation of the eyelets during installation of nuts for the stud construction or where screws are installed. This adds extra cost and complexity to the eyelet and installation process. Wire orientation is important for engine compartment use to prevent vehicle vibration from rotating the wire and loosening the nut, and to prevent wire pinching. One such example of a conventional orientation configuration is U.S. Pat. No. 5,292,264 entitled "Earthing Stud" which issued to Blank on Mar. 8, 1994, which discloses a threaded weld stud, interlocking plastic orientation part, and a cable terminal or eyelet; this patent is incorporated by reference herein. Another traditional construction is disclosed in EP 0 487 365 B1 to Rapid S.A.

SUMMARY OF THE INVENTION

In accordance with the present invention, a preferred embodiment of an electrical connection employs a stud having a patterned segment, a shoulder and a flange. In another aspect of the present invention, the shoulder has seven or more predominantly flat faces. In a further aspect of the present invention, the shoulder has an octagonal cross sectional shape. Still another aspect of the present invention provides a nut which is threadably engaged with the patterned segment of the stud and an eyelet secured between the nut and the flange of the stud. Yet another aspect of the present invention allows the stud to be welded onto an automotive body panel or the like for use as a grounding stud.

The stud and electrical connection of the present invention are advantageous over traditional devices in that the present invention maximizes the electrical contact area between the stud and the eyelet while also providing a set angular orientation to the eyelet and wire once the nut has been fastened onto the stud. The present invention also improves the electrical cross sectional area through the stud while also allowing for the manufacture of the stud in conventionally sized equipment. The preferred octagonal cross sectional shape of the shoulder advantageously increases automatic alignment of the eyelet, especially when the eyelet has a matching octagonal internal aperture shape, as compared to stud shoulders having six or less flat faces. The stud of the present invention advantageously accepts both an octagonally apertured eyelet for use as a grounding stud or a circularly apertured eyelet for use in other electrical stud connections such as to a junction box, battery or the like. Additional advantages and features of the present invention will become apparent from the following description and appended claims, taken in conjunction with the accompanying drawings.

DETAILED DESCRIPTION OF THE PREFERRED EMBODIMENT

Figure 1:
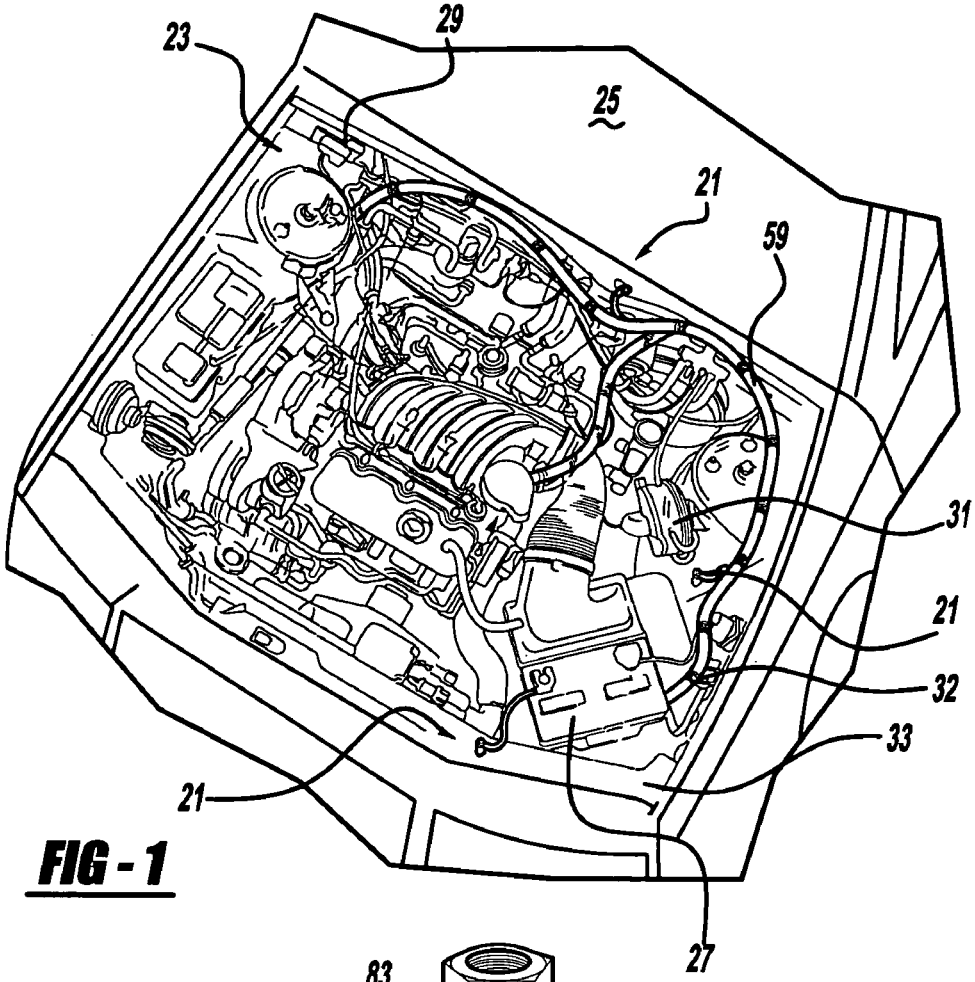
FIG. 1 is a perspective view showing an engine compartment of an automotive vehicle employing the preferred embodiment of a stud and electrical connection of the present invention.
Figure 2:
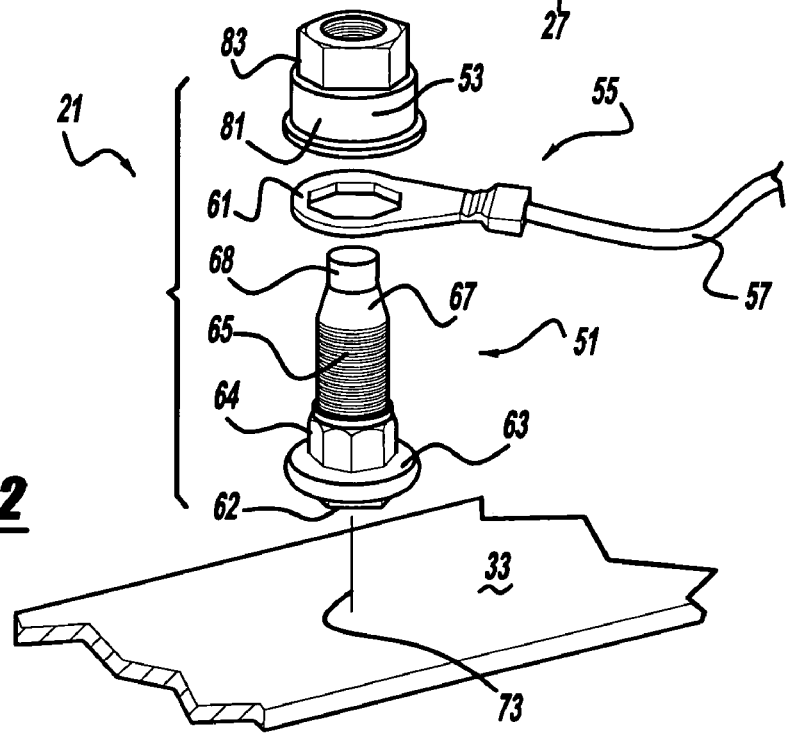
FIG. 2 is an exploded view showing the preferred embodiment stud and electrical connection.
Figure 3:
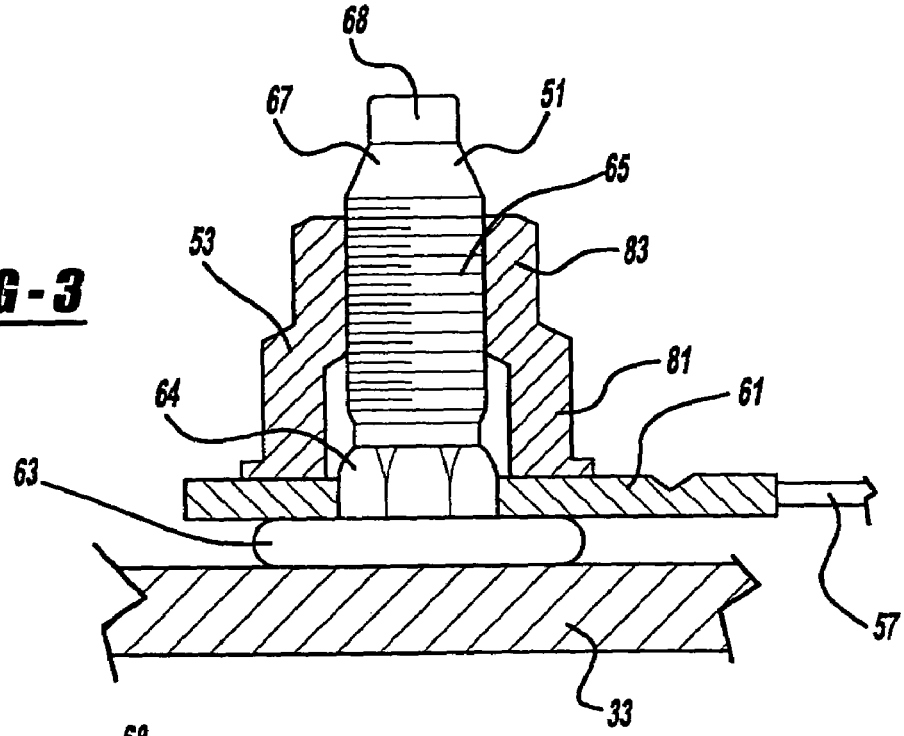
FIG. 3 is a side elevational view, taken partially in cross section, showing the preferred embodiment stud and electrical connection mounted to a vehicle body panel.

FIG. 1 shows a stud electrical connection 21 of the present invention employed in an engine compartment 23 of an automotive vehicle 25. Stud electrical connection 21 is operable to conduct electricity from an electrical component, such as a battery 27, direct current window wiper motor 29, horn 31, power distribution box 32 or the like, to a conductive metal panel or frame 33 of the vehicle.

Referring to FIGS. 2–7, the preferred embodiment of stud electrical connection 21 includes a grounding weld stud 51, a nut 53, and a female electrical connector 55. Electrical connector 55 includes a wire 57, branching from a wire harness 59 (see FIG. 1), with a stamped metal eyelet 61 crimped onto an end thereof. Wire 57 is made of a flexible copper inner wire surrounded by an insulative casing.

Figure 4:
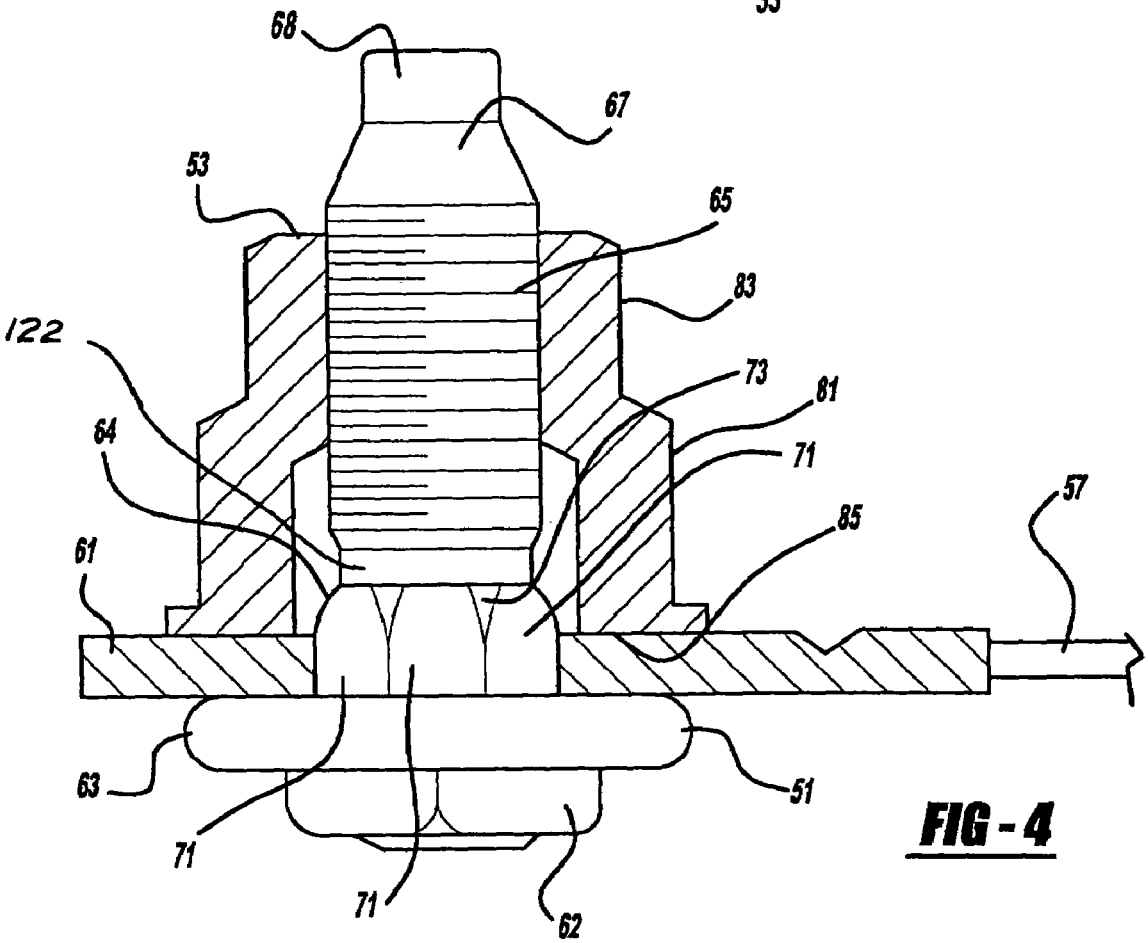
FIG. 4 is a side elevational view, taken partially in cross section, showing the preferred embodiment stud and electrical connection.
Figure 5:
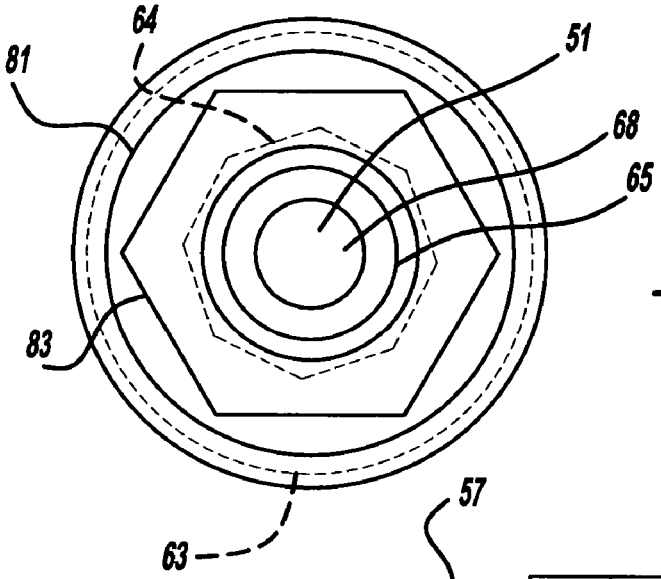
FIG. 5 is an end elevational view showing the preferred embodiment stud and nut.
Figure 6:
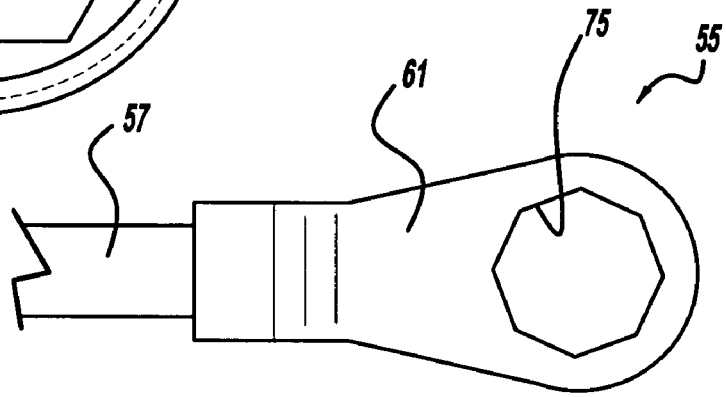
FIG. 6 is a true elevational view showing the preferred embodiment of an eyelet employed with the stud and electrical connection of the present invention.
Figure 7:
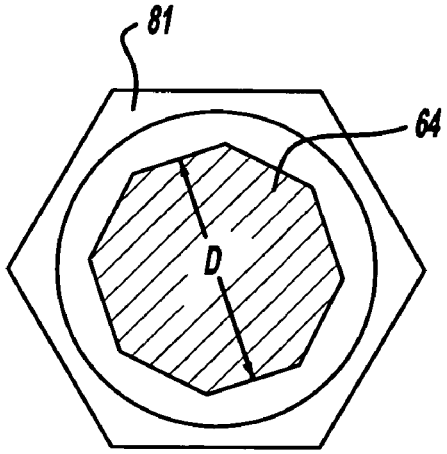
FIG. 7 is a cross sectional view showing the preferred embodiment stud and electrical connection.

Stud 51 includes a securing segment 62, a flange 63, a shoulder 64, a patterned segment 65, an inwardly tapered segment 67 and an anti-cross threading lead-in end segment 68. Securing segment 62 has a hexagonal cross sectional shape with a centrally raised button. This portion forms the weld pool of material when stud 51 is drawn arc welded to panel 33. Flange 63 has a circular peripheral shape and transversely extends beyond the rest of stud 51. A unthreaded and reduced diameter neck 122 of stud 51 is located between the threaded segment and the shoulder, as shown in FIG. 4. The neck is somewhat different than the to a major diameter of the threaded segment and a cross-sectional area of the shoulder.

Shoulder 64 is defined by a set of generally flat faces 71 that are connected together and surround a longitudinal centerline 73 of stud 51. It is important that shoulder 64 has more than six distinctly separate and angularly offset faces that are connected together in a polygonal manner when viewed in cross section. It is preferred that faces 71 of shoulder 64 define an octagonal shape in cross section. Rounded upper corners 73 are located between portions of each adjacent pair of faces 71. The distance D between opposed faces 71 is preferably between 6.13 and 6.0 millimeters. Patterned segment 65 has a M 6.0×1.0 millimeter spiraling thread. The thread defines an external engagement pattern on the stud. Stud 51 is made as an integral single piece from 10B21, heat treated class 8.8 steel. Anti-cross threading segment 68 is of the type disclosed in one or more of the following U.S. Pat. No. 6,162,001 entitled "Anti-Cross Threading Fastener" which issued to Goodwin et al. on Dec. 19, 2000; U.S. Pat. No. 6,022,786 entitled "Anti-Cross Treading [sic] Fastener Lead-In Point" which issued to Garver et al. on May 16, 2000; and U.S. Pat. No. 5,730,566 entitled "Anti-Cross Threading Fastener" which issued to Goodwin et al. on Mar. 24, 1998; all of which are incorporated by reference herein.

The preferred embodiment eyelet 61 has an internal aperture 75 defined by an octagonally shaped edge. Aperture 75 of eyelet 61 closely matches the size of shoulder 64; close dimensional tolerances of aperture 75 and shoulder 64 are important.

Nut 53 has a circular-cylindrical, enlarged section 81 and a coaxial, reduced section 83. A hexagonal cross sectional shape is externally provided on reduced section 83 while a spiral thread is internally disposed within reduced section 83 for engaging the threads of stud 51. Enlarged section 81 has a flanged end 85 which abuts against and compresses eyelet 61 against flange 63 of stud 51, when nut 53 is rotatably tightened by a torque wrench or the like upon stud 51. In the fully fastened position, enlarged section 81 of nut 53 externally surrounds and covers at least part of shoulder 64. Alternately, nut 53 is of a progressive torque, crown lock variety.

In the electrical grounding stud application, stud 51, with nut 53 preassembled to prevent e-coat and paint incursion, is first welded to panel 33. Subsequently, nut 53 is removed. Next, eyelet 61 is manually placed around threaded segment 65 of stud 51. Nut 53 is thereafter rotatably driven onto stud. The rotation of nut 53 will cause the octagonal aperture 75 of eyelet 61 to become automatically aligned with the matching faces of the octagonal shoulder 64, thereby allowing a fixed orientation of eyelet 61 and wire 57 relative to stud 51. Nut 53 is then fully torqued onto stud. It is believed that the octagonal shape maximizes the face-to-face dimension D and also the corner-to-corner dimension of shoulder 64. Notwithstanding, the cross sectional dimensions of shoulder 64 still allow for manufacturing of stud 51 in conventionally sized processing equipment. Additionally, the octagonal cross sectional shape of shoulder 64 allows for reduced circumferential rotation or angular displacement of the corresponding eyelet before alignment is achieved, especially compared to hexagonal or square cross sectional shapes.

Figure 8:
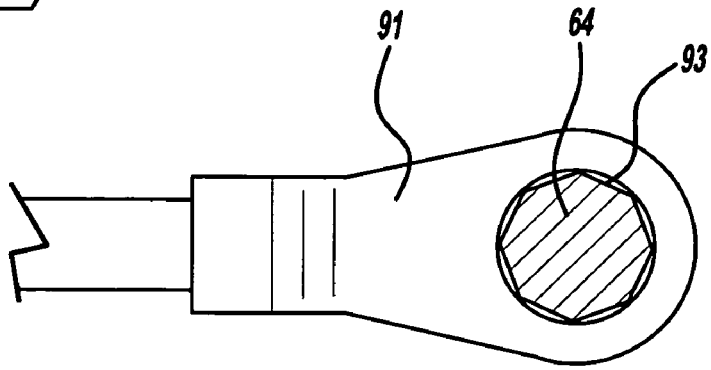
FIG. 8 is a true elevational view showing an alternate embodiment eyelet employed with the stud and electrical connection of the present invention.

An alternate embodiment eyelet 91 is shown in FIG. 8. This eyelet 91 has a circular internal aperture 93 which fits around octagonal shoulder 64. This eyelet configuration is more suitable for non-grounding electrical connections, such as for junction boxes or batteries, where locked in wire orientation is not as important.

While the preferred embodiment grounding stud and electrical connection have been disclosed, it should be appreciated that other aspects can be employed within the scope of the present invention. For example, the securing segment of the stud can alternately have a screw thread, be suitable for spot welding or have an interference fit type push in configuration to the adjacent panel or member. Additionally, the internal nut threads can be replaced by inwardly projecting formations that are in a non-spiral configuration. Furthermore, nut 53 can be replaced by a crimped on collar. The stud electrical connection can also be used for non-automotive apparatuses such as household appliance, power tools or industrial machines. While various materials have been disclosed, other materials may be employed. It is intended by the following claims to cover these and any other departures from the disclosed embodiments which fall within the true spirit of this invention.

The invention claimed is:

1. A connection comprising:

an elongated weld stud having an enlarged flange, a shoulder, a threaded segment and a first end segment, the shoulder being located between the flang and the threaded segment, and the shoulder having eight substantially flat faces circumferentially located around a longitudinal axis of the weld stud;

a nut having an internal thread; and an eyelet attached to the weld stud, at the shoulder, by the nut, wherein the eyelet includes an internal opening with at least eight flat surfaces, defining a closed polygon, corresponding to and contacting against the flat faces of the shoulder, the nut operably securing the eyelet to the enlarged flange of the weld stud, and the nut further having a through hole through which the first end segment extends;

wherein the configuration of the shoulder and the faces of the eyelet assist in self-aligning the eyelet onto the shoulder of the weld stud when assembled;

wherein the weld stud further comprises a weldable segment located on a second end of the weld stud opposite the first end segment;

wherein the enlarged flange is located adjacent the shoulder and opposite the threaded segment, the enlarged flange being transversely larger than the shoulder and the threaded segment, and the enlarged flange having a substantially flat face adjacent the shoulder; and wherein the threaded segment, shoulder and weldable segment are all made as a single piece.

2. The connection of claim 1 wherein the nut has an enlarged section operably enclosing at least a substantially side-facing portion of the shoulder of the stud.

3. The connection of claim 2 wherein the nut has a reduced section having at least four substantially flat faces circumferentially located around the through hole of the nut.

4. The connection of claim 2 wherein the enlarged section has a circular cylindrical exterior shape.

5. The connection of claim 1 wherein the flange of the stud has a circular periphery coaxially aligned with the longitudinal axis.

6. The connection of claim 1 wherein the shoulder includes curved portions between sections of adjacent pairs of the faces of the stud, and the faces of the stud define a polygonal cross sectional shape.

7. The connection of claim 1 further comprising an automotive vehicle body panel, wherein the stud is an electrical grounding stud welded to the panel.

8. The connection of claim 1 wherein the eight faces of the shoulder are arranged in an octagonal cross sectional configuration.

9. An apparatus comprising:

(a) a weld stud comprising:

(i) a threaded segment spiraling around a longitudinal centerline;

(ii) a shoulder located adjacent the threaded segment and having at least eight substantially flat faces surrounding the longitudinal centerline defining a polygonal cross sectional shape;

(iii) a neck located between the threaded segment and the shoulder; and (iv) a weldable segment located on an end of the stud;

wherein the threaded segment, shoulder and securing weldable segment are integrated as a single piece, the weldable segment having a larger transverse dimension than that of the shoulder;

(b) a nut defining a through hole comprising:

(i) a cylindrical section; and (ii) an internally threaded and substantial polygonal section coaxially aligned with the cylindrical section, at least one of the sections of the nut surrounding at least part of the shoulder of the stud;

(c) an eyelet attached to the stud, at the shoulder, by the nut, wherein the eyelet includes an internal opening with at least eight flat surfaces, defining a closed polygon, corresponding to and contacting against the flat faces of the shoulder; and (d) an automotive vehicle panel welded to the weldable segment of the stud.

10. The apparatus of claim 9 wherein the shoulder has eight faces which define an octagonal cross sectional shape.

11. The apparatus of claim 9 wherein the stud further comprises an enlarged flange located adjacent the shoulder opposite the threaded segment, the flange is transversely larger than the shoulder and the threaded segment, and the flange has a circular peripheral shape and a substantially flat face adjacent the shoulder.

12. The apparatus of claim 9 wherein at least the threaded segment and shoulder are made as a single piece.

13. An automotive vehicle apparatus comprising:

(a) an automotive vehicle weld stud comprising;

(i) a threaded segment spiraling around a longitudinal centerline;

(ii) a shoulder located adjacent the threaded segment and having at least eight substantially flat faces surrounding the longitudinal centerline defining a substantially polygonal cross sectional shape;

(iii) a neck located between the threaded segment and the shoulder, the neck being different than the threaded segment and the shoulder; and (iv) a weldable segment located on an end of the stud;

(v) an enlarged flange located adjacent the shoulder opposite the threaded segment, the flange being transversely larger than the shoulder and the threaded segment, and the flange having a circular peripheral shape and a substantially flat face adjacent the shoulder;

wherein the weldable segment has a larger transverse dimension than that of the shoulder; and wherein the threaded segment, shoulder, neck and weldable segment are all made as a single piece;

(b) a nut defining a through hole comprising an internally threaded and substantially polygonal section; and (c) an eyelet attached to the stud, at the shoulder, by the nut, wherein the eyelet includes an internal opening with at least eight flat surfaces, defining a closed polygon;

wherein the flat surfaces of the eyelet contact against the flat faces of the shoulder allowing electricity to pass between the faces of the eyelet and the shoulder; and wherein the configurations of the shoulder and internal opening of the eyelet encourage alignment of the eyelet to the shoulder during insertion.

14. The apparatus of claim 13 wherein the shoulder has eight faces which define an octagonal cross sectional shape.

15. The apparatus of claim 13 wherein at least one of the sections of the nut surrounds at least part of the shoulder of the stud.

16. The apparatus of claim 13 further comprising an automotive vehicle panel welded to the weldable segment of the stud.

17. The apparatus of claim 13 wherein the nut further comprises an enlarged section operably enclosing at least a portion of the shoulder of the stud.

18. The apparatus of claim 13 wherein the nut further comprises an external surface having a cylindrical shape coaxially aligned with the polygonal section.

* * * * *